United States Patent [19]

Ohmori et al.

[11] 4,419,755

[45] Dec. 6, 1983

[54] METHOD FOR MEASURING THE EXTENT OF SLAG DEPOSIT BUILDUP IN A CHANNEL INDUCTION FURNACE

[75] Inventors: Tsuguharu Ohmori; Shizuo Hayashi, both of Suzuka, Japan

[73] Assignee: Fuji Electric Company, Ltd., Kawasaki, Japan

[21] Appl. No.: 421,909

[22] Filed: Sep. 23, 1982

[30] Foreign Application Priority Data

Sep. 29, 1981 [JP] Japan ..... 56-156887

[51] Int. Cl.[3] ..... H05B 5/04

[52] U.S. Cl. ..... 373/145; 373/159; 373/162; 373/149

[58] Field of Search ..... 373/149, 150, 147, 148, 373/159-165, 145

[56] References Cited

U.S. PATENT DOCUMENTS 2,519,941 8/1950 Tama ..... 373/161
2,541,841 2/1951 Tama ..... 373/161

FOREIGN PATENT DOCUMENTS 2856172 7/1979 Fed. Rep. of Germany ..... 373/145

*Primary Examiner*—Roy N. Envall, Jr.

*Attorney, Agent, or Firm*—Brumbaugh, Graves, Donohue & Raymond

[57] ABSTRACT

Disclosed is a method for measuring the extent of slag deposit buildup in the channel of a channel induction furnace during operation. The method comprises measuring an initial temperature rise factor in the furnace at a time when no slag deposits are present, measuring a subsequent temperature rise factor in the furnace after the furnace has been in operation for a period of time, correcting the subsequent temperature rise factor for any changes in the operating temperature and power levels applied to the furnace which may have taken place between the time of the measurement of the initial temperature rise factor and the time of the measurement of the subsequent temperature rise factor, and determining a quantity which is indicative of the extent of slag deposit buildup in the channel from the difference between the initial and subsequent temperature rise factors. The temperature rise factor in the furnace is defined as the ratio of the total weight of the molten metal in the furnace to the time required for the temperature of the molten metal to rise by a predetermined amount above the operating temperature of the furnace when the induction heating power applied to the furnace is increased by a specified amount above the operating power level of the furnace.

3 Claims, 1 Drawing Figure

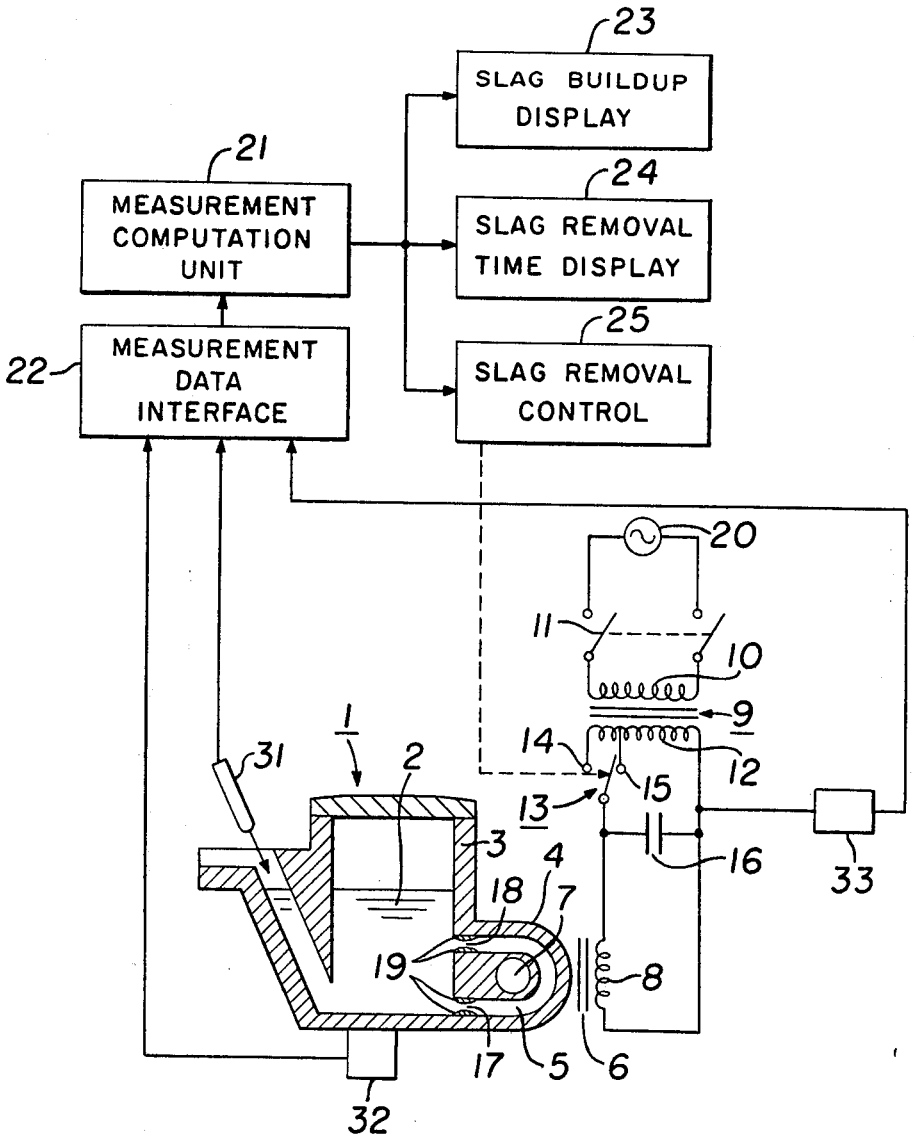
23
SLAG BUILDUP DISPLAY
21
MEASUREMENT COMPUTATION UNIT
24
SLAG REMOVAL TIME DISPLAY
25
SLAG REMOVAL CONTROL
22
MEASUREMENT DATA INTERFACE
20
11
10
9
1
2
31
14
12
15
13
3
16
33
4
18
7
19
8
17
5
6
32

METHOD FOR MEASURING THE EXTENT OF SLAG DEPOSIT BUILDUP IN A CHANNEL INDUCTION FURNACE

BACKGROUND OF THE INVENTION

The present invention relates to a method for measuring the extent of slag deposit buildup in the channel of a channel induction furnace.

A typical channel induction furnace used for melting metals comprises a container for holding molten metal and a U-shaped channel in communication with the container through two vertically spaced apart openings in the container wall and forming a loop path for the molten metal. Heating of the metal in such a furnace is accomplished by inductively coupling an electrical current in the metal in the loop path to provide resistance heating of the metal in the channel and to cause a convection flow of heated metal from the channel into the container. A problem with channel conduction furnaces is that slag in the molten metal tends to deposit on the walls of the channel near the openings thereof. Such slag deposits tend to restrict the convection flow of molten metal through the channel and thus reduce the heat transfer between the channel and the container. If the slag deposits are permitted to buildup sufficiently so as to cause significant blockage of the channel, heating of the metal in the container may become inadequate for maintaining the metal at a desired operating temperaure while the metal in the channel may become so overheated that the refractory lining of the channel is damaged causing leakage of molten metal to occur. Therefore, slag deposits in the channel of the channel induction furnace must be detected and removed before such blockage occurs.

One technique for detecting and removing the slag deposits is to visually inspect the channel after the furnace has been emptied and cooled down and to manually remove any slag deposits. However this technique is unsatisfactory inasmuch as cooling of the furnace tends to produce cracks in the furnace walls and thus unacceptably shortens the life of the furnace.

An improved technique for removing slag deposits which does not require cooling the furnace is disclosed in commonly assigned Japanese Patent Application No. 136515-1980, filed Sept. 30, 1980. With the improved technique slag deposits which are within certain limits of buildup may be removed by temporarily increasing the induction heating of the channel above that which is necessary to maintain the furnace at a desired operating temperature. The increased channel heating causes softening of the slag deposits and a strong convection flow of molten metal in the channel resulting in rapid erosion of the slag deposits. However, in order to use the improved slag removal technique, the extent of slag deposit buildup in the channel must be precisely measured while the furnace is in operation in order to permit a determination of the start and the duration of the increased channel heating necessary for slag removal without overheating the channel.

Heretofore known methods for measuring the extent of slag deposit buildup in the channel of an operating furnace include: measuring the change in power factor in the channel induction heating unit caused by a deterioration of the channel lining due to blockage and overheating of the channel; and measuring the increase in channel temperature resulting from blockage of the channel by slag deposits by an appropriate temperature sensing means such as a thermocouple or an optical pyrometer. However, these known methods are deficient for the purpose of controlling slag removal by increased induction heating owing primarily to a lack of precision in the measurements of the extent of slag deposit buildup provided thereby. In the power factor measurement method it is difficult to establish a precise relationship between the deterioration of the channel lining and the extent of slag deposit buildup. Moreover, it is desirable to remove the slag deposits before any deterioration in the channel lining takes place. In the channel temperature measurement method it is again difficult to precisely relate a rise in the channel temperature to the extent of slag deposit buildup. Therefore, a need clearly exists for a method for precisely measuring the extent of slag deposit buildup in the channel of an operating channel induction furnace.

SUMMARY OF THE INVENTION

The deficiencies of the above-described known measurement methods are substantially overcomed by the present invention which is a method for measuring the extent of slag deposit buildup in the channel of an operating channel induction furnace of the type described above. According to the present invention, an initial temperature rise factor is measured in the furnace before any slag deposits are present, the temperature rise factor being the ratio of the weight of molten metal in the furnace to the time required for the temperature of the molten metal to rise by a predetermined amount when induction heating power applied to the furnace is increased by a specified amount. A subsequent temperature rise factor is then measured in the furnace after the furnace has been in operation for a selected interval of time. A quantity indicative of the extent of slag deposit buildup in the furnace is determined from the difference between the initial and subsequent temperature rise factors. In the preferred embodiment of the invention, the subsequent temperature rise factor measurement is corrected for any changes in the operating temperature and operating power of the furnace which may have taken place between the time of the initial temperature rise factor measurement and the time of the subsequent temperature rise factor measurement.

BRIEF DESCRIPTION OF THE DRAWING

The sole FIGURE in the drawing is a schematic and partial block diagram depicting apparatus for measuring the extent of slag deposit buildup in a channel induction furnace according to the present invention and for removing such slag deposits.

DETAILED DESCRIPTION

Referring now to the sole FIGURE, the furnace 1 is formed with a refractory material and comprises a container 3 for holding molten metal 2 and a U-shaped channel 4 in communication with the container 3 through vertically spaced openings 17 and 18 in the wall of the container and forming a loop path 5 for the molten metal. A hole 7 passes through the center of the loop path. The furnace is heated by means of inductive heating unit comprising a closed ferromagnetic core 6 (represented schematically) which passes through the hole 7 formed by the channel and an induction coil 8 which is wound on the core. An electrical power source 20 provides an AC current to the coil 8 through a switch 11, a transformer 9 and a tap change switch 13.

The AC current in the coil 8 causes a current to be inductively coupled to the metal in the loop path 5 formed by the channel and gives rise to resistance heating of the metal in the channel. The heating of the metal in the channel results in a convection flow of the heated metal from the channel into the container to heat the metal 2 in the container. The operating power level applied to the induction heating unit is adjusted to keep the molten metal in the container at a desired operating temperature.

Owing to the presence of slag in the molten metal in the furnace, slag deposits 19 tend to form near the openings of the channel and build up with time. The presence of such slag deposits is undesirable inasmuch as such deposits may cause blockage of convection flow through the channel and result in reduced heat transfer from the channel to the container and consequent overheating of the metal in the channel. If the extent of the slag deposit buildup is with certain limits, the deposits may be removed by temporarily increasing the induction heating of the channel to soften the deposits and to increase the convection flow through the channel. To provide such increased induction heating, the secondary winding 12 of the transformer 9 has two taps 14 and 15. In normal operation, the tap change switch connects the coil 8 to the low voltage tap 15 to provide the operating power level to the induction heating unit. However, when slag removal is required, the tap change switch connects the coil 8 to the high voltage tap 14 to increase the electrical power provided to the induction heating unit by a specified amount above the operating power level.

Operation of the tap change switch is under the control of a slag deposit measurement system comprising a measurement data interface 22 including an A/D converter and a measurement computation unit 21 including a microprocessor for receiving measurement data from the data interface 22. The measurement computation unit provides data to a slag deposit buildup display 23 which indicates the extent of slag deposit buildup. The measurement computation unit also provides data to a slag removal time display 24 which indicates the duration of increased induction heating for slag removal and to a slag removal control circuit 25 which controls the position of the tap change switch 13. The measurement data interface 22 is coupled to receive data from a temperature sensor 31 for measuring the temperature of the molten metal in the container, an electromechanical transducer 32 for measuring the weight of molten metal in the furnace and a power detector 33 for measuring the electrical power supplied to the induction heating unit. The temperature sensor 31 is inserted into the container through a tapping port and is dipped into the molten metal when a temperature measurement is required.

The method for measuring the extent of slag deposit buildup in the channel of the furnace is now described. Initially when there is no slag deposits in the channel, such as when the lining of the channel is first applied or is renewed, the measurement systems measures and stores an initial temperature rise factor $S_0$ defined as $$S_o = \frac{W_o}{H_o}, \tag{1}$$

where $W_0$ is the total initial weight (in tons) of the molten metal in the furnace and $H_0$ is the time (in hours) required for the temperature of the molten metal to rise by 100° C. from an initial operating temperature of $T_0$ when the electrical power applied to the induction heating unit is increased from an initial operating power level $N_0$ (in kilowatts) to a higher initial measurement power level $P_0$ (in kilowatts). The initial operating power level $N_0$ is that required to maintain the temperature of the molten metal in the container at the initial operating temperature $T_0$. The measurement system also measures a temperature rise energy $e_0$ for a 100° C. rise in the molten metal temperature. The quantity $e_0$ is defined as $$e_o = \frac{(P_o - N_o)\eta}{W_o/H_o} = \frac{(P_o - N_o)\eta}{S_o}, \tag{2}$$

where $\eta$ is the efficiency of the induction coil which is typically 95%. The temperature rise energy for a 1° C. rise in the molten metal temperature is then $e_0/100$.

After the furnace has been in operation for a period of time, the measurement system makes subsequent temperature rise factor measurements at selected intervals. A subsequent temperature rise factor $S_1$ is defined as $$S_l = \frac{W_l}{N_l}, \tag{3}$$

where $W_1$ is the total weight (in tons) of molten metal at the subsequent time and $H_1$ is the time required for the temperature of the molten metal to rise by 100° C. from a subsequent operating temperature of $T_1$ when the power applied to the induction heating apparatus is increased from a subsequent operating power level $N_1$ (in kilowatts) to a subsequent measurement power level $P_1$ (in kilowatts). The subsequent operating power level $N_1$ maintains the molten metal temperature at $T_1$.

The extent of slag deposit buildup in the channel may be computed from the difference between the initial and subsequent temperature rise factors. However, before the difference is computed, the subsequent temperature rise factor $S_1$ may be corrected for any changes in the operating temperature of the molten metal and the operating power level which may have taken place between the time of the initial measurement and that of the subsequent measurement. The corrected value of the subsequent temperature rise factor $S_1'$ is given approximately as $$S'_l = \frac{P_o - N'_l}{P_l - N'_l} S_l, \tag{4}$$

where $N_1'$ is the corrected operating power level at the subsequent time given approximately as $$N'_l = \frac{T_o}{T_l} N_l. \tag{5}$$

Combining equations (4) and (5), one obtains $$S'_l = \frac{P_o - (T_o/T_l)N_l}{P_l - (T_o/T_l)N_l} S_l \tag{6}$$

Any difference between $S_0$ and $S_1'$ is related to a reduction in heat transfer between the molten metal in the channel and that in the container. Such a reduction in heat transfer is caused by a decrease in the convection flow of molten metal through the channel resulting from a partial blockage of the channel by slag deposits.

During the measurement of $S_1$, the additional temperature rise $\Delta T_c$ in the molten metal in the channel resulting from a decrease in convection flow may be approximately expressed as $$\Delta T_c = \frac{100Q}{e_o W_i}, \tag{7}$$

where $W_i$ is the weight (in tons) of molten metal within the channel and Q is the additional energy retained in the channel when the measurement power level $P_1$ is applied for a time x (in hours), the additional retained energy being a result of the reduced heat transfer between the channel and the container. The additional energy Q retained in the channel may also be expressed as $$Q = (S_o - S'_l) \times \frac{e_o}{100} \frac{1}{\eta}. \tag{8}$$

Combining equations (7) and (8), the additional temperature rise $\Delta T_c$ in the channel may be expressed as $$\Delta T_c = \frac{1}{W_i \eta} (S_o - S'_l)\, x = K(S_o - S'_l)x. \tag{9}$$

where $K = 1/W_i\eta$.

Thus the additional temperature rise in the channel caused by a decrease in the convection flow of molten metal is proportional to the difference in temperature rise factors ($S_0$–$S_1'$).

The additional energy Q retained in the channel as a result of the restriction of the convection flow of molten metal through the channel is proportional to the degree of restriction. Therefore, a quantity of representing the extent of slag deposit buildup may be defined such that $$Q = K'f. \tag{10}$$

where K' is a proportionality constant. Combining equations (7) and (9) one obtains $$f = K''x(S_0 - S_1') \tag{11}$$

where $K'' = e_0/100\eta K'$. Thus, if the time interval x is fixed, the quantity f representing the extent of slag deposit buildup is proportional to the difference ($S_0 - S_1'$) in the temperature rise factor.

Accordingly, the value of the constant K'' is obtained through prior calibration of the system and stored in the measurement computation unit along with the predetermined value of x. After a new lining is applied to the furnace or after an old lining has been renewed, the quantitites $W_0$, $H_0$, $T_0$, $P_0$ and $N_0$, as defined above, are measured by the measurement system. Then the value of $S_0$ is computed according to equation (1) and stored in a memory in the measurement computation unit. Programming of the microprocessor in the measurement computation unit 21 to solve equation (1) and to store the result would be obvious to one skilled in the art and, therefore, need not be further described. The furnace is then operated with the tap change switch 13 connecting the induction heating coil 8 to the low voltage tap 15. After a predetermined period of operation, the quantities $W_1$, $H_1$, $T_1$, $P_1$ and $N_1$, as defined above, are measured by the measurement system. The value of $S_1'$ is then computed according to equations (3) and (6). Subsequently, the value of f is computed according to equation (11) and provided to the slag deposit buildup display 23. Programming of the microprocessor in the measurement computation unit to solve equations (3), (6) and (11) would be obvious to one skilled in the art and, therefore, need not be further described.

If the computed value of f exceeds a predetermined limit, the measurement computation unit further computes a slag deposit removal time $\tau$ according to a precalibrated relationship between $\tau$ and f. The computed value of $\tau$ is provided to the slag removal time display 24 and to the slag removal control circuit 25. The slag removal control circuit causes the tap change switch 13 to connect the induction heating coil 8 to the high voltage tap 15 for the duration $\tau$. As already explained above, connection of the induction coil to the high voltage tap of the transformer 9 results in an increase in the induction heating of the channel and the removal of the slag deposits in the channel.

During slag deposit removal, the temperature of the molten metal in the channel must be kept below a temperature limit where damage to the channel lining begins to occur. For a typical lining material, this limit is 1750° C. It has been determined empirically that, in the absence of slag deposits in the channel, the steady state temperature of the molten metal in the channel of a typical furnace is approximately 100° C. higher than the temperature of the molten metal in the container. If the molten metal temperature in the container is $T_0$ and the excess channel temperature due to slag deposits is $\Delta T_c$, the channel temperature $\theta$ may be expressed as $$\theta = T_0 + 100 = \Delta T_c. \tag{12}$$

For the case where $T_0$ is 1500° C., the upper limit for $\Delta T_c$ may be expressed as $$\Delta T_c \leqq 1750\text{-}100\text{-}1500 = 150^\circ\ \text{C.}, \tag{13}$$

combining expression (13) in equation (9), one obtains $$\Delta T_c = \frac{(S_o - S'_l)}{W_i \eta} \tau \leqq 150^\circ\ \text{C.} \tag{14}$$

The upper limit for the slag removal time $\tau$ may be expressed as $$\tau \leqq \frac{W_i \eta 150}{S_o - S'_l}. \tag{15}$$

It will be noted that because the quantity ($S_0 - S_1'$) is a function of the subsequent measurement power level $P_1$, defined above, the upper limit on the slag removal time $\tau$ is also a function of $P_1$. The upper limit on $\tau$ is computed by the measurement computation unit 21 according to equation 14 and the value of $\tau$ provided to the slag removal control circuit is kept below that limit.

It will be understood by one skilled in the art that various modifications and substitutions may be made to the disclosed embodiment without departing from the spirit and scope of the invention. For example, other types of circuits may be used for changing the power supplied to the induction heating unit as by altering the voltage applied to the induction heating coil or by the intermittent application of a fixed voltage to the coil. Furthermore, the measurement system may be implemented with analog rather than digital circuitry and measurement of furnace temperature may be made by means other than the immersion of a temperature sensor into the molten metal.

I claim:

1. A method for measuring the extent of slag deposit buildup in a channel induction furnace during operation, the furnace including a container portion for holding molten metal, a channel portion in communication with the container portion and heating means for supplying power to heat metal in the channel portion, the heating means supplying power at a power first level for maintining the molten metal in the container portion at an operating temperature, the method comprising the steps of: measuring a first temperature rise factor in the furnace at a time when there are substantially no slag deposits present, the temperature rise factor being the ratio of the weight of the molten metal in the furnace to the time required for the temperature of the molten metal in the container portion to rise by a predetermined amount above the operating temperature when the power supplied by the heating means is increased to a second power level which is greater than first level by a specified amount; measuring a second temperature rise factor in the furnace at a selected time after the furnace has been in operation for a period of time; and determining a quantity indicative of the extent of slag deposit buildup at the selected time from the difference between the first and the second temperature rise factors.

2. A method as recited in claim 1 further comprising the step of correcting the second temperature rise factor for any variations in the operating temperature of the furnace and in the first and second power levels which may have taken place between the time the first temperature rise factor was measured and the time the second temperature rise factor was measured.

3. A method for measuring the extent of slag deposit buildup in a channel induction furnace during operation, the furance including a container portion for holding molten metal, a channel portion in communication with the container portion and heating means for supplying power to heat metal in the channel portion, the heating means supplying power at a first level for maintaining the molten metal in the container portion at an operating temperature, the method comprising the steps of: during a first measurement interval when there are substantially no slag deposits in the furnace, increasing the power supplied by the heating means to a second level $P_0$ greater than the first level by a specified amount; measuring during the first measurement interval the quantities $W_0$, $H_0$, $T_0$ and $N_0$, where $W_0$ is the weight of molten metal in the furnace, $H_0$ is the time required for the molten metal in the container portion to rise by a predetermined amount above the operating temperature after the power supplied by the heating means is increased to $P_0$, $T_0$ is the operating temperature before the power supplied by the heating means is increased and $N_0$ is the first level of power supplied by the heating means during the first measurement interval; determining a first temperature rise factor $S_0$ according to the relationship $S_0=W_0/H_0$; during a second measurement interval at a selected time after the first measurement interval, increasing the power supplied by the heating means to a second level $P_1$ greater than the first level by a specified amount; measuring during the second measurement interval the quantities $W_1$, $H_1$, $T_1$ and $N_1$, where $W_1$ is the weight of molten metal in the furance, $H_1$ is the time required for the molten metal in the container portion to rise by a predetermined amount above the operating temperature after the power supplied by the heating means is increased to $P_1$, $T_1$ is the operating temperature before the power supplied by the heating means is increased and $N_1$ is the first level of power supplied by the heating means during the second measurement interval; determining a second temperature rise factor $S_1$ according to the relationship $S_1=W_1/H_1$; determining a corrected second temperature rise factor $S_1'$ according to the relationship $$S'_l = \frac{P_o - (T_o/T_l)N_l}{P_l - (T_o/T_l)N_l} S_l;$$

determining a quantity f indicative of the extent of slag buildup in the furnace during the second measurement interval according to the relationship $f=C(S_0-S_1')$ where C is a proportionality constant.

* * * * *